US006599685B1

(12) United States Patent
Kong

(10) Patent No.: US 6,599,685 B1
(45) Date of Patent: Jul. 29, 2003

(54) THERMALLY DEVELOPABLE IMAGING MATERIALS HAVING IMPROVED SHELF STABILITY AND STABILIZING COMPOSITIONS

(75) Inventor: Steven H. Kong, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/041,386

(22) Filed: Jan. 8, 2002

(51) Int. Cl.[7] ..... G03C 1/498; G03C 5/16; G03C 1/76

(52) U.S. Cl. ..... 430/350; 430/510; 430/523; 430/600; 430/613; 430/614; 430/619; 430/620; 430/944; 430/961; 430/965

(58) Field of Search ..... 430/350, 613, 430/619, 600, 264, 614, 944, 620, 615, 510, 523, 965, 961; 252/583, 589

(56) References Cited

U.S. PATENT DOCUMENTS

| | | | | |
|---|---|---|---|---|
| 3,080,254 A | | 3/1963 | Grant, Jr. | |
| 3,951,660 A | * | 4/1976 | Hagemann et al. | |
| 4,123,282 A | | 10/1978 | Winslow | |
| 4,144,072 A | * | 3/1979 | Ikenoue et al. | |
| 5,599,647 A | * | 2/1997 | Defiew et al. | 430/200 |
| 5,747,412 A | * | 5/1998 | Leenders et al. | 503/201 |
| 6,143,488 A | * | 11/2000 | Uytterhoeven et al. | 430/619 |
| 6,146,822 A | * | 11/2000 | Asanuma et al. | 430/619 |
| 6,171,767 B1 | | 1/2001 | Kong et al. | |

FOREIGN PATENT DOCUMENTS

| | | |
|---|---|---|
| JP | 98 339934 A | 10/1998 |
| JP | 00 010231 A | 1/2000 |

OTHER PUBLICATIONS

U.S. patent application Ser. No. 09/638,679, filed Aug. 15, 2000, titled "Photothermographic Materials Providing Improved Image Stability And Methods Of Use" by Kong et al.

* cited by examiner

*Primary Examiner*—Thorl Chea
(74) *Attorney, Agent, or Firm*—J. Lanny Tucker; Louis M. Leichter

(57) ABSTRACT

Thermally developable photothermographic materials comprise a backside layer that includes a toner as a backside stabilizer. Useful backside stabilizers include pyridazine, phthalazine, phthalazinone, benzoxazine dione, benzthiazine dione, or quinazoline dione compounds, or derivatives of any of these compounds to provide improved shelf stability. These backside stabilizers can be provided particularly in non-photosensitive compositions that include an antihalation composition.

23 Claims, 6 Drawing Sheets

THERMALLY DEVELOPABLE IMAGING MATERIALS HAVING IMPROVED SHELF STABILITY AND STABILIZING COMPOSITIONS

FIELD OF THE INVENTION

This invention relates to thermally developable imaging materials such as photothermographic materials. More particularly, it relates to photothermographic imaging materials that have improved shelf stability. The invention also relates to methods of imaging using these materials. In addition, this invention relates to unique backside compositions that also provide stabilization of photothermographic materials. This invention is directed to the photothermographic imaging industry.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photosensitive catalyst (such as silver halide) that upon such exposure provides a latent image in exposed grains that are capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998).

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$, The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette 's Eighth Edition*), noted above, *Unconventional Imaging Processes*, E. Brinckman et al. (Eds.), The Focal Press, London and New York, 1978, pp. 74–75, in C. Zou et al., *J. Imaging Sci. Technol.* 1996, 40, pp. 94–103, and in M. R. V. Sahyun, *J. Imaging Sci. Technol.* 1998, 42, 23.

Problem to be Solved

The ability of a photothermographic material to be stored without undergoing changes in sensitometric or physical properties is often referred to as "raw-stock keeping". One aspect of improving raw-stock keeping is the control of fog. Photothermographic emulsions, in a manner similar to photographic emulsions and other light-sensitive systems, tend to suffer from fog. Fog is spurious image density that appears in non-imaged areas of the element after development and is often reported in sensitometric results as Dmin. In efforts to make more sensitive photothermographic elements, one of the most difficult parameters to control and to maintain at a very low level is the various types of fog or Dmin.

As described above, photothermographic materials contain both the image-forming chemistry and the development chemistry in one or more thermally developable imaging layers. During storage and prior to use, the image-forming and development chemistry may degrade or may prematurely chemically react. Later, upon imaging and development, this reaction will be observed as an increase in Dmin in the non-imaged areas. This reaction shortens the shelf-life of photothermographic materials and is often referred to as "shelf-aging fog". A great amount of work has been done to improve the shelf-life characteristics of photothermographic materials. In order to destroy fog centers or to limit their growth during development, additional additives, such as stabilizers and antifoggants, are incorporated into the imaging layers.

There is a continuing need in the industry to reduce shelf-aging fog and thus improve Dmin.

SUMMARY OF THE INVENTION

The present invention solves the noted problems with a photothermographic material that comprises a support having on one side thereof, one or more thermally-developable imaging layers comprising a binder and in reactive association, a photosensitive silver halide, a non-photosensitive source of reducible silver ions, and a reducing composition for the non-photosensitive source reducible silver ions, and on the opposite side of said support, a backside layer comprising a toner as a backside stabilizer.

In one embodiment, the toner in the backside layer on the opposite side of the support, comprises a pyridazine, phthalazine, phthalazinone, benzoxazine dione, benzthiazine dione, and quinazoline dione compound, or a derivative of any of these compounds as a backside stabilizer.

Further, this invention provides a method of forming a visible image comprising:

A) imagewise exposing the photothermographic material described above to electromagnetic radiation to form a latent image, and B) simultaneously or sequentially, beating the exposed photothermographic material to develop the latent image into a visible image.

When the photothermographic materials of this invention are heat-developed as described below in a substantially water-free condition after, or simultaneously with, imagewise exposure, a silver image (preferably a black-and-white silver image) is obtained. The photothermographic material may be exposed in step A using any source of radiation to which they are sensitive, including ultraviolet light, visible light, near infrared radiation, infrared radiation, or any other radiation source readily apparent to one skilled in the art. One particularly preferred form of useful radiation is infrared radiation generated by an infrared laser, an infrared laser diode, an infrared light-emitting diode, an infrared lamp, or any other infrared radiation source readily apparent to one skilled in the art.

In some embodiments, wherein the photothermographic material comprises a transparent support, the image-forming method further comprises:

C) positioning the exposed and heat-developed photothermographic material with a visible image therein, between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

In preferred embodiments, the backside stabilizers described above are provided in non-photosensitive compositions of this invention that comprise an antihalation composition, a binder, and phthalazine or a phthalazine derivative.

The present invention provides a number of advantages with the presence in a backside layer of certain stabilizer compounds, such as pyridazine, phthalazine, phthalazinone, benzoxazine dione, benzthiazine dione, and quinazoline dione compounds (defined below) and their derivatives. These compounds are identified herein as "backside stabilizers". While many of these compounds have been previously used in frontside imaging layers as image toners, when used in a backside layer, I found that they improved shelf-aging stability of the photothermographic materials. Thus, I found a reduction in the change in Dmin over time (that is, a reduction in ΔDmin).

In preferred embodiments, the backside stabilizers are also present as toners in one or more imaging layers on the frontside of the photothermographic materials. In one preferred embodiment, the same backside stabilizer is used as a toner in the same photothermographic material.

DETAILED DESCRIPTION OF THE INVENTION

Figure 1:
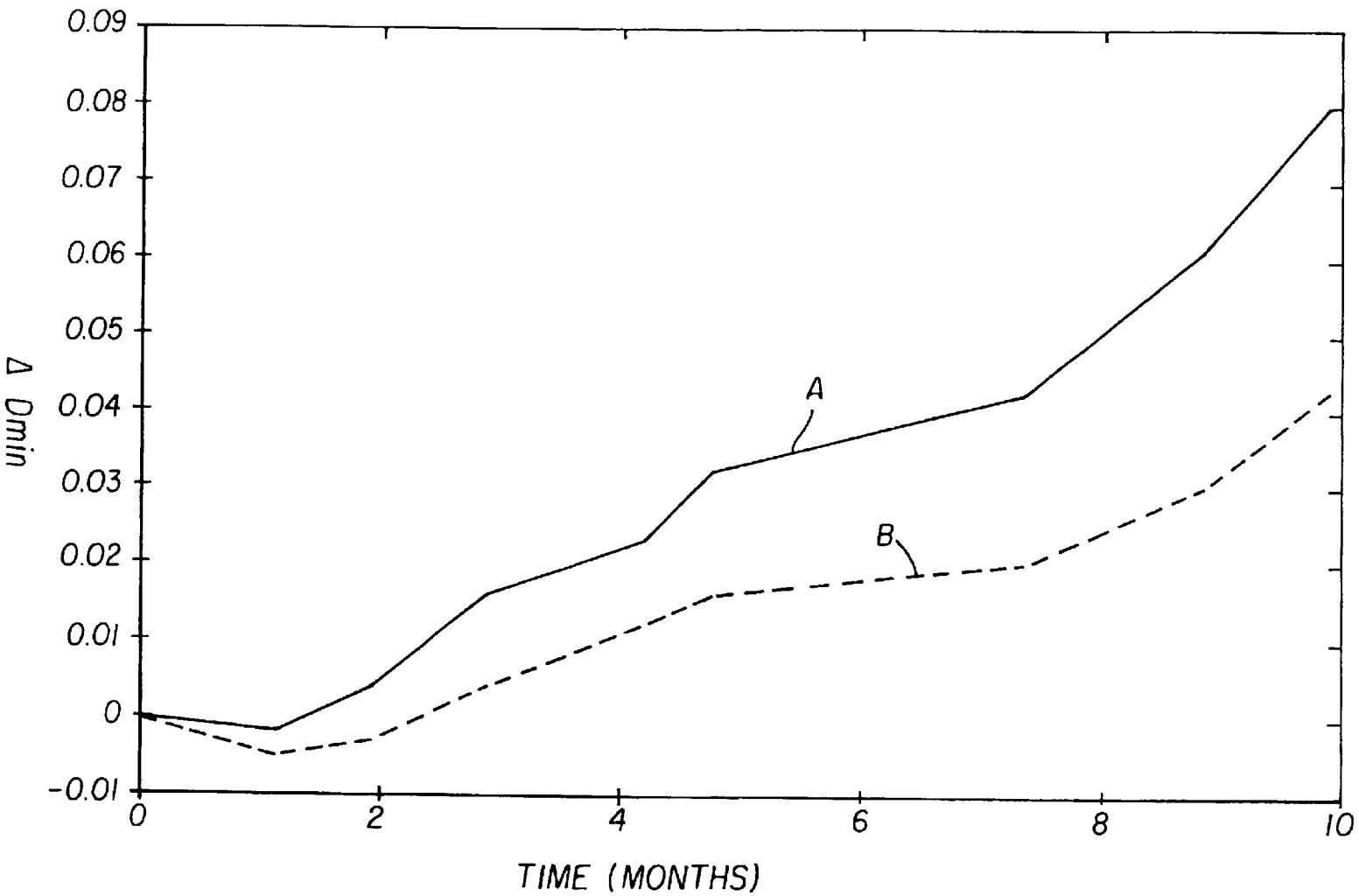
FIG. 1 is a graphical representation of the change in Dmin of a photothermographic material with phthalazine (Curve B) and without phthalazine (Curve A) in the back coating vs. shelf aging time as described in Example 1 below.

The photothermographic materials of this invention can be used, for example, in conventional black-and-white or color photothermography and in electronically generated black-and-white or color hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing. The photothermographic materials of this invention are particularly useful for medical, dental, and veterinary radiography to provide black-and-white images.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer. "Catalytic proximity" or "reactive association" means that they are in the same layer or in adjacent layers.

One or more layers are disposed on the "backside" (non-emulsion side) of the materials, including antihalation layer(s), protective layers, antistatic layers, conducting layers, and transport enabling layers. As described herein, at least one of these backside layers contains one or more of the backside stabilizers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

Definitions

As used herein:

In the descriptions of the photothermographic materials of the present invention, "a" or "an" component refers to "at least one" of that component. For example, the backside stabilizers can be used individually or in combinations.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak, Rochester, N.Y., 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer", "imaging layer", or "photothermographic emulsion layer" means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed" or "photographic speed", absorbance, Dmin, and Dmax have conventional definitions known in the imaging arts. Particularly, Dmin is considered herein as image density achieved when the photothermographic material is thermally developed without prior exposure to radiation.

"AC-1" is defined herein as the average contrast between an optical density of 0.6+Dmin and an optical density of 2.0+Dmin "SPD-3" is defined herein as 4-log($E_2$) wherein $E_2$ (optical density) is equal to 2.9+Dmin.

"Transparent" means capable of transmitting visible light or imaging radiation without appreciable scattering or absorption.

Toners are compounds that when added to the photothermographic imaging layer shift the color of the developed silver image from yellowish-orange to dark brown-black/blue-black.

As is well understood in this art, for the various compounds herein described, substitution is not only tolerated, but is often advisable and various substituents are anticipated on the backside stabilizers used in the present invention (as shown below). Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a phthalazine or phthalazinone ring structure is shown (including fused ring structures), substituent groups may be placed on the phthalazine or phthalazinone ring structure, but the atoms making up the phthalazine or phthalazinone ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide, silver bromoiodide, and mixtures thereof are more preferred, with the latter silver halide having up to 10 mol % silver iodide. Typical techniques for preparing and precipitating silver halide grains are described in *Research Disclosure*, 1978, Item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps".

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp.94–122, and in C. E. K. Mees and T. H. James, *The Theory of the Photographic Process*, Third Edition, Macmillan, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm), U.S. Pat. No. 4,076,539 (Ikenoue et al.), and JP Applications 13224/74, 42529/76, and 17216/75.

In some instances, it may be helpful to prepare the photosensitive silver halide grains in the presence of a hydroxytetrazindene (such as 4-hydroxy-6-methyl-1,3,3,3a,7-tetrazaindene) or an N-heterocyclic compound comprising at least one mercapto group (such as 1-phenyl-5-mercaptotetrazole) to provide increased photospeed. Details of this procedure are provided in U.S. Pat. No. 6,413,710B1 (Shor et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical and Spectral Sensitizers

The photosensitive silver halides used in the invention may be may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in *Research Disclosure*, Item 38957 (noted above) and in T. H. James, *The Theory of the Photographic Process*, Fourth Edition, Eastman Kodak, Rochester, N.Y., 1977, Chapter 5, pp.

149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915,371 (Lok et al.).

In one embodiment, chemical sensitization is achieved by oxidative decomposition of a spectral sensitizing dye in the presence of a photothermographic emulsion. Such sensitization is described in U.S. Pat. No. 5,891,615 (Winslow et al.), incorporated herein by reference.

In another embodiment, certain substituted and unsubstituted thiourea compounds can be used as chemical sensitizers. Particularly useful tetra-substituted thioureas are described in U.S. Pat. No. 6,368,779 (Lynch et al.), that is incorporated herein by reference.

Still other useful chemical sensitizers include certain tellurium-containing compounds that are described in copending and commonly assigned U.S. Ser. No. 09/975,909 (filed Oct. 11, 2001 by Lynch, Opatz, Shor, Simpson, Willett, and Gysling), that is incorporated herein by reference.

Combinations of gold(III)-containing compounds and either sulfuror tellurium-containing compounds are useful as chemical sensitizers as described in U.S. Pat. No. 6,423,481 (Simpson et al.), that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and would be readily determinable by one of ordinary skill in the art.

In general, it may also be desirable to add spectral sensitizing dyes to enhance silver halide sensitivity to ultraviolet, visible, and/or infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes, hemicyanine dyes, and complex merocycaine dyes are particularly useful. The cyanine dyes preferably include benzothiazole, benzoxazole, and benzoselenazole dyes that include one or more alkylthio, arylthio, or thioether groups. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.) are effective in the practice of the invention. All of the patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in photothermographic materials of this invention can be any organic compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic (fatty) acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof Preferably, at least silver behenate is used alone or in mixtures with other silver salts.

Representative examples of the silver salts of aromatic carboxylic acid and other carboxylic acid group-containing compounds include, but are not limited to, silver benzoate, and silver substituted-benzoates (such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate, silver tannate, silver phthalate, silver terephthalate, silver salicylate, silver phenylacetate, and silver pyromellitate).

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the $\alpha$- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido) benzothiazole, a silver salt of 5-carboxylic-1-methyl2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptotriazole derivative, such as a silver salt of 3-amino-5-benzylthio-1,2,4-triazole), and a silver salt of thione compounds [such as a silver salt of 3-(2-carboxyethyl)-4-methyl-4-thiazoline-2-thione as described in U.S. Pat. No. 3,785,830 (Sullivan et al.).

Examples of other useful silver salts of mercapto or thione substituted compounds that do not contain a heterocyclic nucleus include but are not limited to, a silver salt of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

In some embodiments, a silver salt of a compound containing an imino group is preferred especially in aqueous-based photothermographic formulations. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of benzotriazole is most preferred in aqueous-based photothermographic formulations.

Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercial fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Non-photosensitive sources of reducible silver ions can also be provided as core-shell silver salts such as those described in U.S. Pat. No. 6,355,408 (Whitcomb et al.), that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in U.S. Pat. No. 6,472,131B1 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the are would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/m^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.).

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more high-contrast co-developing agents and co-developer contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl) methanes, bis(hydroxyphenyl)methanes (that is bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX or PERMANAX WSO), 1,1'-bis(3,5-di-t-butyl-4-hydroxyphenyl)methane, 2,2'-bis (4-hydroxy-3-methylphenyl)propane, 4,4'-ethylidene-bis(2-t-butyl-6-methylphenol), 2,2'-isobutylidene-bis(4,6-dimethylphenol) (LOWINOX 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzopbenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), and 3-pyrazolidones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,923,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 nm to about 100 nm. Further details about the various dye absorbance values are provided in U.S. Pat. No. 5,491,059 (noted above, Col. 14).

The total amount of one or more dye-forming or dye-releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The photothermographic materials of the invention can also contain other additives such as shelf-life stabilizers, toners, antifoggants, contrast enhancing agents, development accelerators, acutance dyes, post-processing stabilizers or stabilizer precursors, and other image-modifying agents as would be readily apparent to one skilled in the art.

To further control the properties of photothermographic materials, (for example, contrast, Dmin, speed, or fog), it may be preferable to add one or more heteroaromatic mercapto compounds or heteroaromatic disulfide compounds of the formulae Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP-A-0 559 228 (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.), incorporated by reference.

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described, for example, in EP-A-0 600,586 (Philip, Jr. et al.), and tribromomethylketones as described, for example, in EP-A-0 600,587 (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as hose having a $—SO_2C(X')_3$ group wherein X' represents the same or different halogen atoms.

The use of "toners" or derivatives thereof that improve the image is highly desirable in the one or more imaging layers on the frontside of the photothermographic materials of this invention. Preferably, if used on the frontside, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes (such as hexaaminecobalt (3+) trifluoroacetate), mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 4-p-chlorophenylphthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachloropbthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (III), rhodium bromide, rhodium nitrate, and potassium hexachlororhodate (III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine, phthalazine derivatives [such as those described in U.S. Pat. No. 6,146,822 (noted above)], phthalazinone, and phthalazinone derivatives are particularly preferred as toners on the frontside of the photothermographic materials.

Backside Stabilizers

The benefits of the present invention are achieved by incorporating one or more of certain compounds in a non-photosensitive backside layer of the photothermographic materials. Generally, this non-photosensitive backside layer is an antihalation layer (described below), but it can be an interlayer, antistatic layer, topcoat protective layer, or other layer on that side. Preferably, the backside stabilizers are present in one or more antihalation layers that are formulated from an antihalation composition as described below. In more preferred embodiments, the backside layer is the sole layer on the backside of the support.

The backside stabilizers useful for this purpose are phthalazine, phthalazine derivatives [including those described in U.S. Pat. No. 6,146,822 (noted above)], phthalazinone, and phthalazinone derivatives, pyridazine and pyridazine derivatives, and benzoxazine dione, benzthiazine dione, and quinazoline dione compounds and their derivatives. Phthalazine and phthalazine derivatives are particularly preferred.

Particularly useful backside stabilizers are represented by the following Structures I, II, III, and IV:

I

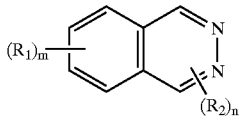

II

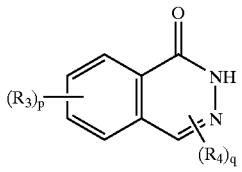

III

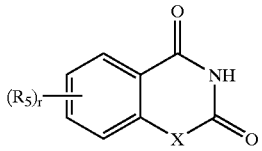

IV

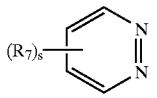

In formulae I, II, III, and IV, $R_1$, $R_2$, $R_3$, $R_4$, $R_5$, and $R_7$ each independently represent hydrogen, alkyl groups, cycloalkyl groups, alkoxy, groups, alkylthio groups, arylthio groups, hydroxy groups, halogen groups, or $N(R_8R_9)$) groups. In addition, any two of $R_1$, $R_2$, $R_3$, $R_4$, $R_5$, or $R_7$ taken together may represent the atoms necessary to form a fused aromatic, heteroaromatic, alicyclic, or heterocyclic ring. When $R_1$, $R_2$, $R_3$, $R_4$, $R_5$, or $R_7$ represent an amino group [$N(R_8R_9)$], $R_8$ and $R_9$ each independently represent hydrogen, alkyl groups, aryl groups, cycloalkyl groups, alkenyl groups, and heterocyclic groups. Additionally, $R_8$ and $R_9$ taken together may represent the atoms necessary to form a substituted or unsubstituted 5- to 7-membered heterocyclic ring. In formulae I, II, III, and IV, X represents 0, S, Se, or $N(R_6)$, where $R_6$ represents hydrogen, alkyl groups, aryl groups, cycloalkyl groups, alkenyl groups, and heterocyclic groups. Finally, m, n, p, q, r, and s are each independently 0, 1, or 2.

Useful alkyl groups for $R_1$, $R_2$, $R_3$, $R_4$, $R_5$, $R_6$, $R_7$, $R_8$, and $R_9$ are linear, branched, or cyclic and can have from 1 to 20 carbon atoms, and preferably can have from 1 to 5 carbon atoms. Most preferable are alkyl groups of from 1 to 4 carbon atoms (such as methyl, ethyl, iso-propyl, n-butyl, t-butyl, and sec-butyl).

Useful aryl groups for $R_1$, $R_2$, $R_3$, $R_4$, $R_5$, $R_6$, $R_7$, $R_8$, and $R_9$ can have from 6 to 14 carbon atoms in the aromatic ring(s). Preferred aryl groups are phenyl groups and substituted phenyl groups.

Useful cycloalkyl groups for $R_1$, $R_2$, $R_3$, $R_4$, $R_5$, $R_6$, $R_7$, $R_8$, and $R_9$ can have from 5 to 14 carbon atoms in the central ring system. Preferred cycloalkyl groups are cyclopentyl and cyclohexyl.

Useful alkenyl and alkynyl groups can be branched or linear and have 2 to 20 carbon atoms. A preferred alkenyl group is allyl.

Useful heterocyclic groups for $R_1$, $R_2$, $R_3$, $R_4$, $R_5$, $R_6$, $R_7$, $R_8$, and $R_9$ can have 5 to 10 carbon, oxygen, sulfur, and nitrogen atoms in the central ring system and can also have fused rings.

These alkyl, aryl, cycloalkyl, and heterocyclic groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxy groups, sulfo groups, phosphono groups, and any other group readily apparent to one skilled in the art.

Useful alkoxy, groups, alkylthio groups, arylthio groups for $R_1$, $R_2$, $R_3$, $R_4$, $R_5$, and $R_7$ are those having alkyl and aryl groups as described above.

Preferred halogen groups are chlorine and bromine.

Compounds represented by Structure I are phthalazine compounds. Compounds represented by Structure II are phthalazinone compounds. Compounds represented by Structure III are benzoxazine dione, benzthiazine dione, and quinazoline dione compounds. Compounds represented by Structure IV are pyridazine compounds.

Representative backside stabilizers useful in the practice of this invention include, but are not limited to, the following compounds I-1 to I-32, II-1 to II-4, III-1 to III-10, and IV-1 to IV-4:

I-1

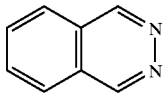

I-2

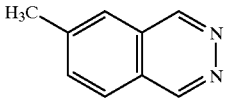

I-3

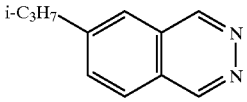

I-4

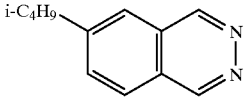

I-5

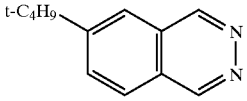

I-6

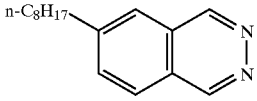

I-7

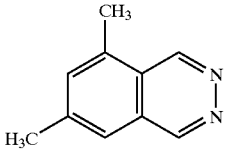

I-8

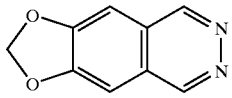

I-9

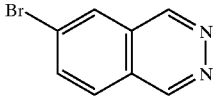

-continued
I-10
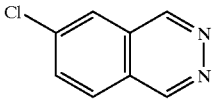
I-11
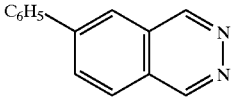
I-12
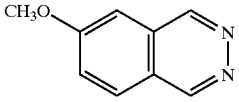
I-13
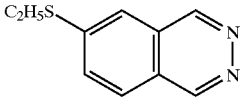
I-14
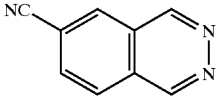
I-15
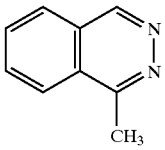
I-16
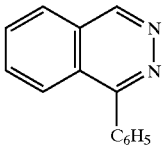
I-17
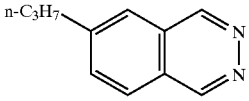
I-18
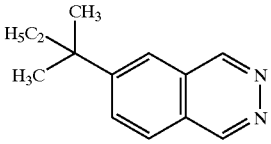
I-19
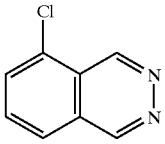
I-20
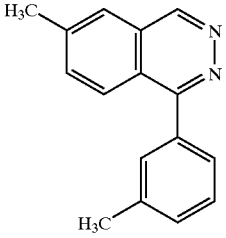
-continued
I-21
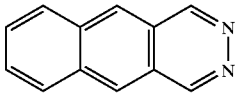
I-22
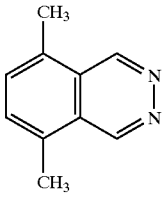
I-23
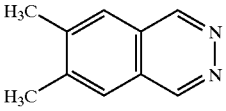
I-24
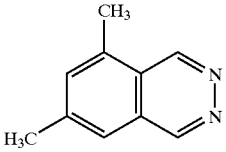
I-25
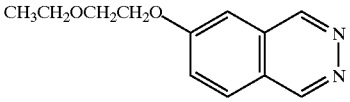
I-26
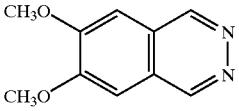
I-27
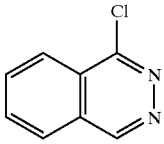
I-28
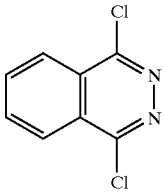
I-29
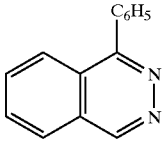
I-30
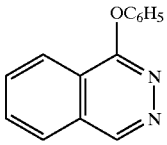

-continued
I-31
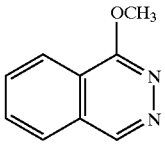
I-32
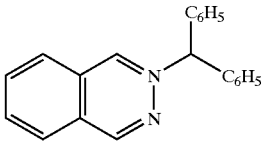
II-1
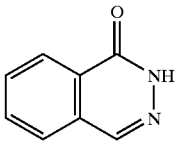
II-2
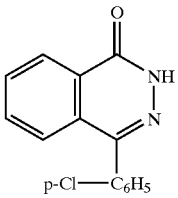
II-3
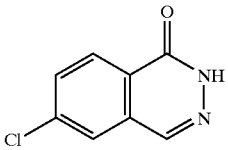
II-4
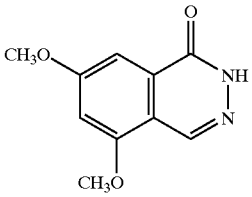
III-1
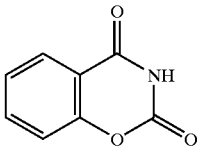
III-2
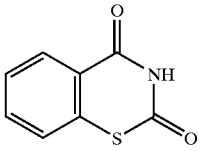
III-3
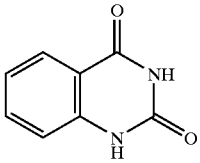
-continued
III-4
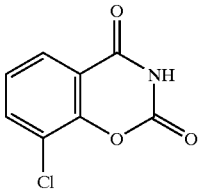
III-5
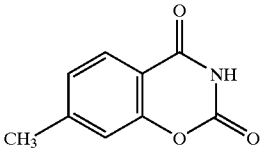
III-6
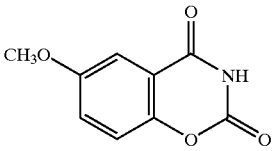
III-7
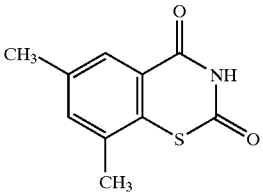
III-8
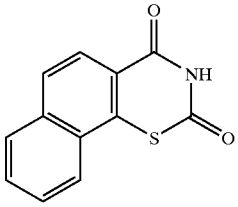
III-9
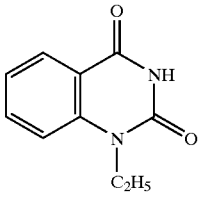
III-10
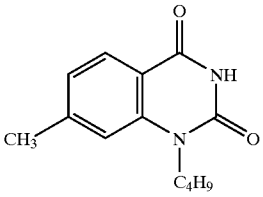
IV-1
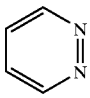
IV-2
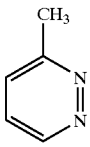

-continued

IV-3

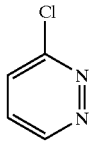

IV-4

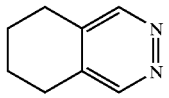

The backside stabilizer(s) used in the present invention are present in one or more backside layers in a total amount on the backside of at least 0.01 mmol/$m^2$, and preferably from about 0.05 to about 5 mmol/$m^2$.

In preferred embodiments, the backside stabilizers are incorporated within non-photosensitive compositions that include one or more antihalation compositions (such as antihalation dyes or heat-bleachable compositions as described below), one or more suitable binders (such as any of those described in the following section, but preferably cellulose acetate binders), and other addenda normally included in such compositions (such as matting agents, lubricants, conductive agents, and cross-linkers. Such compositions can be formulated in suitable solvents including the conventional organic solvents described below for the photothermographic formulations.

The backside stabilizers can be obtained from a number of commercial sources (such as Aldrich Chemical Co.) or prepared using known procedures. Phthalazine compounds can be prepared, for example, as described in Castle, R. N. *Condensed Pyridizines Including Cinnolines and Phthalazines*, Weissberger, A., Ed., Chemistry of Heterocyclic Compounds, Wiley, 1973, Vol. 27.

Binders

The photocatalyst (such as the photosensitive silver halide), the non-photosensitive source of reducible silver ions, the reducing agent composition, and any other additives used in the present invention are generally added to one or more binders that are either hydrophilic or hydrophobic. Thus, either aqueous or solvent-based formnulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR B79 (Solutia, Inc.) and PIOLOFORM BS-18 or PIOLOFORM BL-16 (Wacker Chemical Company). Aqueous dispersions (or latexes) of hydrophobic binders may also be used.

Examples of useful hydrophilic binders include, but are not limited to, proteins and protein derivatives, gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring vehicles commonly known for use in aqueous-based photographic emulsions (see for example, *Research Disclosure*, Item 38957, noted above). Cationic starches can be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described for example in EP-0 600 586B1 and vinyl sulfone compounds as described in U.S. Pat. No. 6,143,487, aldehydes and various other hardeners as described in U.S. Pat. No. 6,190,822 (Dickerson et al.). The hydrophilic binders used in the photothermographic materials are generally partially or fully hardened using any conventional hardener.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly preferred support. Various support materials are described, for example, in *Research Disclosure*, August 1979, item 18431. A method of making dimensionally stable polyester films is described in *Research Disclosure*, September, 1999, item 42536.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone, or tetrahydrofuran.

Alternatively, these components can be formulated with a hydrophilic binder in water or water-organic solvent mixtures to provide aqueous-based coating formulations.

Photothermographic materials of the invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-0 792 476 B1 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials of this invention can be constructed of one or more layers on each side of a support. Single layer materials should contain the photocatalyst, the non-photosensitive source of reducible silver ions, the reducing composition, the binder, as well as optional materials such as toners, acutance dyes, coating aids, and other adjuvants on the frontside of the support. At least one layer is then constructed on the backside to include the backside stabilizer(s) as described above.

Two-layer constructions on the frontside comprise a single imaging layer coating containing all the ingredients and a surface protective topcoat. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned. In such constructions, the materials also include at least one backside layer containing the backside stabilizer(s) as described above.

Layers to promote adhesion of one layer to another in photothermographic materials are also known, as described for example in U.S. Patent 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819B1 (Kenney et al.), U.S. Pat. No. 6,352,820B1 (Bauer et al.), and U.S. Pat. No. 6,420,102B1 (Bauer et al.), all incorporated herein by reference.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405B1 (Ludemann et al.).

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers.

An antihalation layer is preferred in the practice of the present invention and is composed of a suitable antihalation composition. Examples of useful antihalation compositions include various dyes and pigments including carbon black as described for example in U.S. Pat. No. 4,312,941 (Scharf et al.), U.S. Pat. No. 4,581,323 (Fisher et al.), U.S. Pat. No. 4,477,562 (Zeller-Pendrey), U.S. Pat. No. 4,581,325 (Kitchin et al.), U.S. Pat. No. 4,839,265 (Ohno et al.), U.S. Pat. No. 5,985,537 (Philip, Jr. et al.), and EP-A-0 714,046 (Parkinson et al.).

Particularly useful antihalation dyes include dihydroperimidine squaraine dyes having the nucleus represented by the following general Structure AH-1:

AH-1

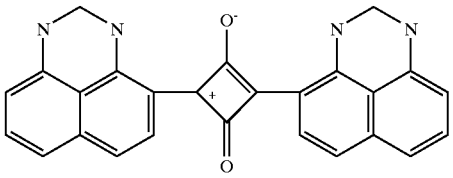

Some of these compounds are described, for example, in U.S. Pat. No. 6,063,560 (Suzuki et al.) and U.S. Pat. No. 5,380,635 (Gomez et al.), both incorporated herein by reference. One particularly useful dihydroperimidine squaraine antihalation dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Another class of dyes particularly useful as antihalation dyes includes indolenine cyanine dyes having the nucleus represented by the following general Structure AH-2:

AH-2

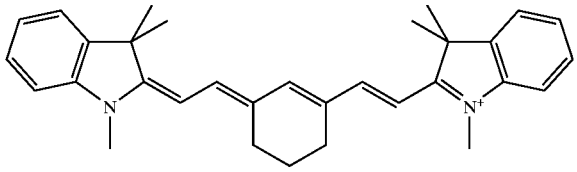

Details of such dyes having the indolenine cyanine nucleus and methods of their preparation can be found in EP-A-0 342 810 (Leichter), incorporated herein by reference. One particularly useful cyanine antihalation dye, compound (6) described therein, is 3H-Indolium, 2-[2-[2-chloro-3-[(1,3-dihydro-1,3,3-trimethyl-2H-indol-2-ylidene) ethylidene]-5-methyl]-1-cyclohexen-1-yl]ethenyl]-1,3,3-trimethyl-, perchlorate.

Heat-bleachable compositions can be used in backside layers as antihalation compositions. Under practical conditions of use, such compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

Useful heat-bleachable antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in copending and commonly assigned U.S. Ser. No. 09/875,772 (filed Jun. 6, 2001 by Goswami, Ramsden, Zielinski, Baird, Weinstein, Helber, and Lynch) and U.S. Pat. No. 6,514,677 (Ramsden et al.).

Other antihalation compositions (such as dyes) that decolorize with heat during processing are described for example in U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

To promote image sharpness, photothermographic materials according to the present invention can contain one or more frontside layers containing acutance dyes. These dyes are chosen to have absorption close to the exposure wavelength and are designed to absorb scattered light. In addition, one or more antihalation dyes may be incorporated into one or more antihalation layers according to known techniques as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques.

Dyes useful as acutance dyes include the dihydroperimidine squaraine dyes having the general structure represented by the Structure AH-1 noted above. One particularly useful acutance dye is cyclobutenediylium, 1,3-bis[2,3-dihydro-2,2-bis[[1-oxohexyl)oxy]methyl]-1H-perimidin-4-yl]2,4-dihydroxy-, bis(inner salt). Another class of dyes particularly useful as acutance dyes includes indolenine cyanine dyes having the general structure AH-2 noted above. One particularly useful acutance dye, is 3H-Indolium, 2-[2-[2-chloro-3-[(1,3-dihydro-1,3,3-trimethyl-2H-indol-2-ylidene) ethylidene]-5-methyl-1-cyclohexen-1-yl]ethenyl]-1,3,3-trimethyl-, perchlorate.

Other useful acutance dyes include those described in U.S. Pat. No. 4,260,676 (Brown), U.S. Pat. No. 4,271,263 (Goettert), and U.S. Pat. No. 4,316,984 (Brown).

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

Imaging/Development

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of from about 300 to about 850 nm. In a preferred embodiment, the photothermographic materials are sensitive to radiation in the range of from about at least 700 nm to about 1400 nm, and preferably from about 750 nm to about 850 nm.

Imaging can be achieved by exposing the photothermographic materials of this invention to a suitable source of radiation to which they are sensitive, including ultraviolet light, visible light, near infrared radiation, and infrared radiation, to provide a latent image. Suitable exposure means are well known and include sources of radiation, including: incandescent or fluorescent lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful exposure means include laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

Use as a Photomask

The photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

A) imagewise exposing the photothermographic material of this invention to electromagnetic radiation to which the photosensitive silver halide of the material is sensitive, to form a latent image, and B) simultaneously or sequentially, heating the exposed photothermographic material to develop the latent image into a visible image.

The photothermographic material may be exposed in step A using any source of radiation to which they are sensitive, including ultraviolet light, visible light, near infrared radiation, infrared radiation, or any other radiation source readily apparent to one skilled in the art. One particularly preferred form of useful radiation is infrared radiation, including an infrared laser, an infrared laser diode, an infrared light-emitting diode, an infrared lamp, or any other infrared radiation source readily apparent to one skilled in the art.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material. Thus, in some other embodiments wherein the photothermographic material comprises a transparent support, the image-forming method further comprises:

C) positioning the exposed and heat-developed photothermographic material with a visible image thereon, between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

The following examples are provided to illustrate the practice of this invention, and are not intended to be limiting in any manner. The examples provide exemplary synthetic and preparatory procedures using backside compositions to provide stabilization of photothermographic materials.

MATERIALS AND METHODS FOR THE EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID A-21 is an acrylic copolymer that is available from Rohm and Haas (Philadelphia, Pa.).

PIOLOFORM BL-16 and PIOLOFORM BS-18 are polyvinyl butyral resin that is available from Wacker Polymer Systems (Adrian, Mich.).

CAB 171-15S and CAB 381-20 are cellulose acetate butyrate resins that are available from Eastman Chemical Co (Kingsport, Tenn.).

CCBA is 4-chlorobenzoyl benzoic acid

DESMODURN3300 is an aliphatic hexamethylene diisocyanate that is available from Bayer Chemicals (Pittsburgh, Pa.).

DRYVIEW Medical Imaging Film is available from Eastman Kodak Company (Rochester, N.Y.).

LZ-9342 is a perfluorinated organic antistatic agent described in U.S. Pat. No. 4,975,363 (Cavallo et al.).

LOWINOX 221B446 is 2,2-isobutylidene-bis-(4,6-dimethylphenol) that is available from Great Lakes Chemical (West Lafayette, Ind.).

MEK is methyl ethyl ketone (or 2-butanone).

MeOH is methanol ($CH_3OH$).

MMBI is 5-methyl-2-mercaptobenzimidazole.

4-MPA is 4-methylphthalic acid.

VITEL PE 2200 is a polyester resin that is available from Bostik, Inc. (Middleton, Mass.).

SYLSIA 310P is synthetic amorphous silica that is available from Fuji Silysia.

SYLOID 74×6000 is synthetic amorphous silica that is available from Grace-Davison.

Vinyl Sulfone-1 (VS-1) is described in U.S. Pat. No. 6,143,487 and has the following structure:

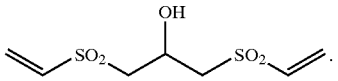

Antifoggant A is 2-(tribromomethylsulfonyl)quinoline and has the following structure:

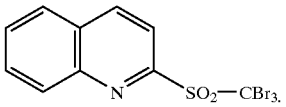

Antifoggant B is described in U.S. Pat. No. 5,686,228 and has the following structure:

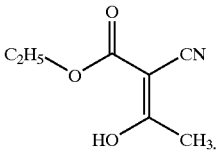

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

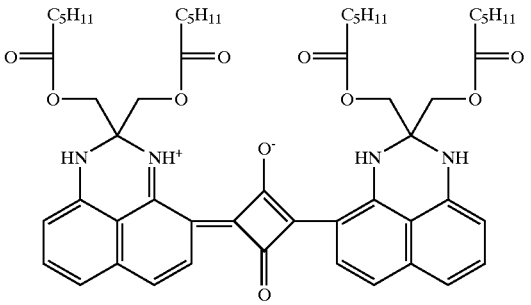

Spectral sensitizing Dye A (X' is iodide) has the following structure:

SSD-A

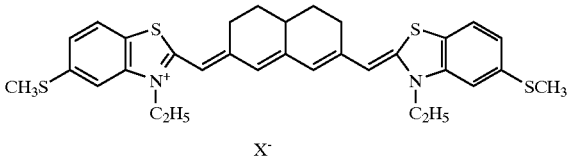

Absorbance was measured on a conventional visible spectrophotometer at the given wavelength in optical density units.

Example 1

A preformed silver halide, silver carboxylate soap dispersion prepared as described in U.S. Pat. No. 5,939,249 (noted above), was homogenized to 28. 1% solids in MEK containing PIOLOFORM BS-18 polyvinyl butyral binder (4.4% solids).

Photothermographic Emulsion Formulation:

To 479 parts of the homogenized silver carboxylate soap dispersion prepared above was added 4.0 parts of a 15% solution of pyridinium hydrobromide perbromide in methanol, with stirring. After 60 minutes of mixing, 5.2 parts of an 11% zinc bromide solution in methanol was added. Stirring was continued and after 30 minutes, an addition was made of a solution of 0.37 parts 2-mercapto-5-methylbenzimidazole, 0.017 parts Sensitizing dye A, 4.1 parts of 2-(4-chlorobenzoyl)benzoic acid, 27 parts of methanol, and 12 parts of MEK. After stirring for 55 minutes, the temperature was lowered to 10° C. After stirring for another 45 minutes, 4.1 parts of a 15% solution of VITEL PE 2200 in MEK was added. After stirring for another 5 minutes, 102.3 parts of PIOLOFORM BL-16 was added. Mixing was continued for another 30 minutes.

The emulsion was completed by mixing for 15 minutes between additions of the following components to each batch:

| | |
|---|---|
| Antifoggant A | 3.2 parts, in 41 parts MEK |
| LOWINOX 221B446 | 23.7 parts |
| DESMODUR N3300 | 1.6 parts, in 0.8 parts MEK |
| Tetrachlorophthalic acid | 0.92 parts, in 2.6 parts MEK |
| Phthalazine | 3.3 parts in 17 parts MEK |
| 4-Methylphthalic acid | 1.5 parts, in 11 parts MEK, and 0.9 parts MeOH |

Protective Topcoat Formulation:

A protective topcoat for the photothermographic formulation was prepared by mixing the following ingredients:

| | |
|---|---|
| ACRYLOID A-21 | 0.97 parts |
| CAB 171-15S | 25.2 parts |
| MEK | 171.5 parts |
| Vinyl sulfone VS-1 | 0.66 parts |
| Benzotriazole | 0.49 parts |
| Antifoggant B | 0.43 parts |
| SYLISIA 310 | 0.38 parts |
| BC-1 dye | 0.39 parts |

Frontside Carrier Formulation:

A frontside carrier formulation was prepared by mixing the following ingredients:

| | |
|---|---|
| VITEL PE 2200 | 0.52 parts |
| PIOLOFORM BL-16 | 12.5 parts |
| MEK | 187 parts |

Backside Stabilizer and Control Formulations:

A master batch of backside stabilizer solution was prepared by mixing the following ingredients:

| | |
|---|---|
| 15% VITEL PE 2200 in MEK | 3.74 parts |
| CAB 281-20 | 40.3 parts |
| MEK | 248 parts |
| SYLOID 74X6000 | 0.52 parts dispersed in 7.1 parts MEK |
| 75% LZ-9342 in MEK | 4.27 parts |

A control backside formulation was prepared by mixing 3.1 parts MEK into 47 parts of the master batch solution.

A stabilizer backside formulation was prepared by mixing 0.035 parts phthalazine (I-1) and 3.1 parts MEK into 47 parts of the master batch solution.

Backside Carrier Formulation:

A backside carrier formulation was prepared by mixing the following ingredients:

| | |
|---|---|
| 15% VITEL PE 2200 in MEK | 1.2 parts |
| CAB 381-20 | 1.0 part |
| MEK | 15.4 parts |
| 2.18% BC-1 in MEK | 22.4 parts |

The frontside carrier, imaging, and topcoat formulations were coated simultaneously onto a 178 $\mu$m polyethylene terephthalate film using a slide coater to provide photothermographic materials of this invention. The silver containing solution was coated to obtain a dry coating weight of about 2 g of silver/$M^2$. The topcoat solution was coated to obtain a dry coating weight of about 0.24 g/$ft^2$ (2.6 g/$m^2$). The frontside carrier solution was coated to obtain a dry coating weight of about 0.03 g/$ft^2$ (0.32 g/$m^2$). Immediately after coating, samples were dried in a forced air oven at between 77° C. and 99° C. for between 4 and 5 minutes.

The backside solution was coated to obtain a dry coating weight of about 0.4 g/$ft^2$ (4.3 g/$m^2$) The backside carrier solution was coated to obtain a backside absorbance between 0.33 and 0.38 at 815 nm.

The photothermographic materials were imagewise exposed using a laser sensitometer and heat-developed in a DRYVIEW Model 2771 processor at 124° C. for 15 seconds to provide continuous tone wedges with optical densities varying from Dmin to an optical density greater than 3.5. Each imaged film was then scanned with a densitometer that takes an optical density reading every 0.25 mm. The resulting data were used to calculate initial Dmin, contrast ("AC-1"), and photospeed ("SPD-3").

The shelf stability of the photothermographic material was evaluated by stacking the film so that the backside coating of one film sheet lay on top of the emulsion side (frontside) of the next film sheet. The stacked films were sealed in a foil bag and aged at room temperature (about 21–24° C. and 40–60% relative humidity). After each month, samples of the aged photothermographic material were removed from the bag, imagewise exposed, heat developed, and scanned in the same manner outlined above. Changes (Δ) in Dmin, "AC-1", and ("SPD-3") were calculated.

Figure 2:
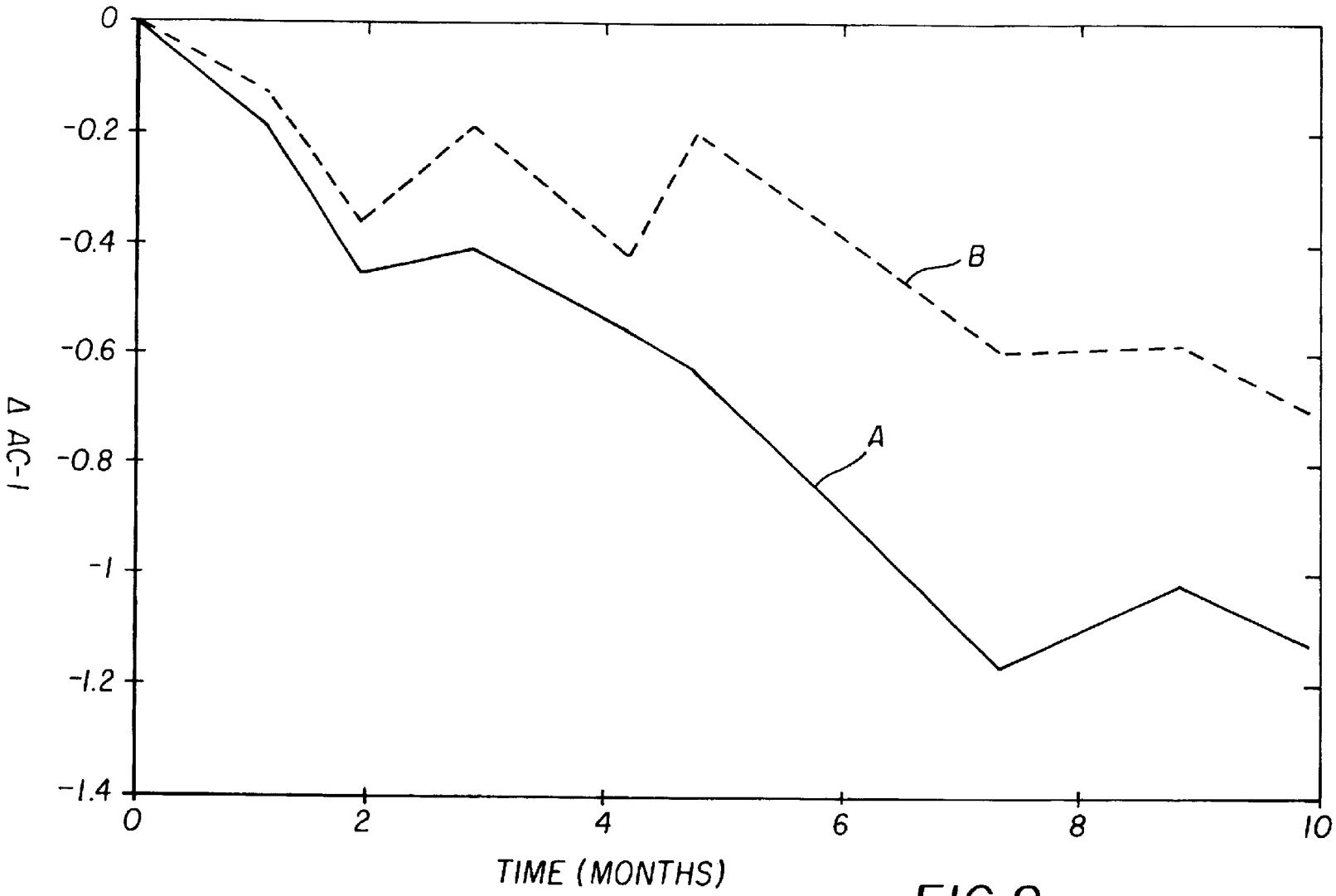
FIG. 2 is a graphical representation of the change in "AC-1" of a photothermographic material with phthalazine (Curve B) and without phthalazine (Curve A) in the back coating vs. shelf aging time as described in Example 1 below.
Figure 3:
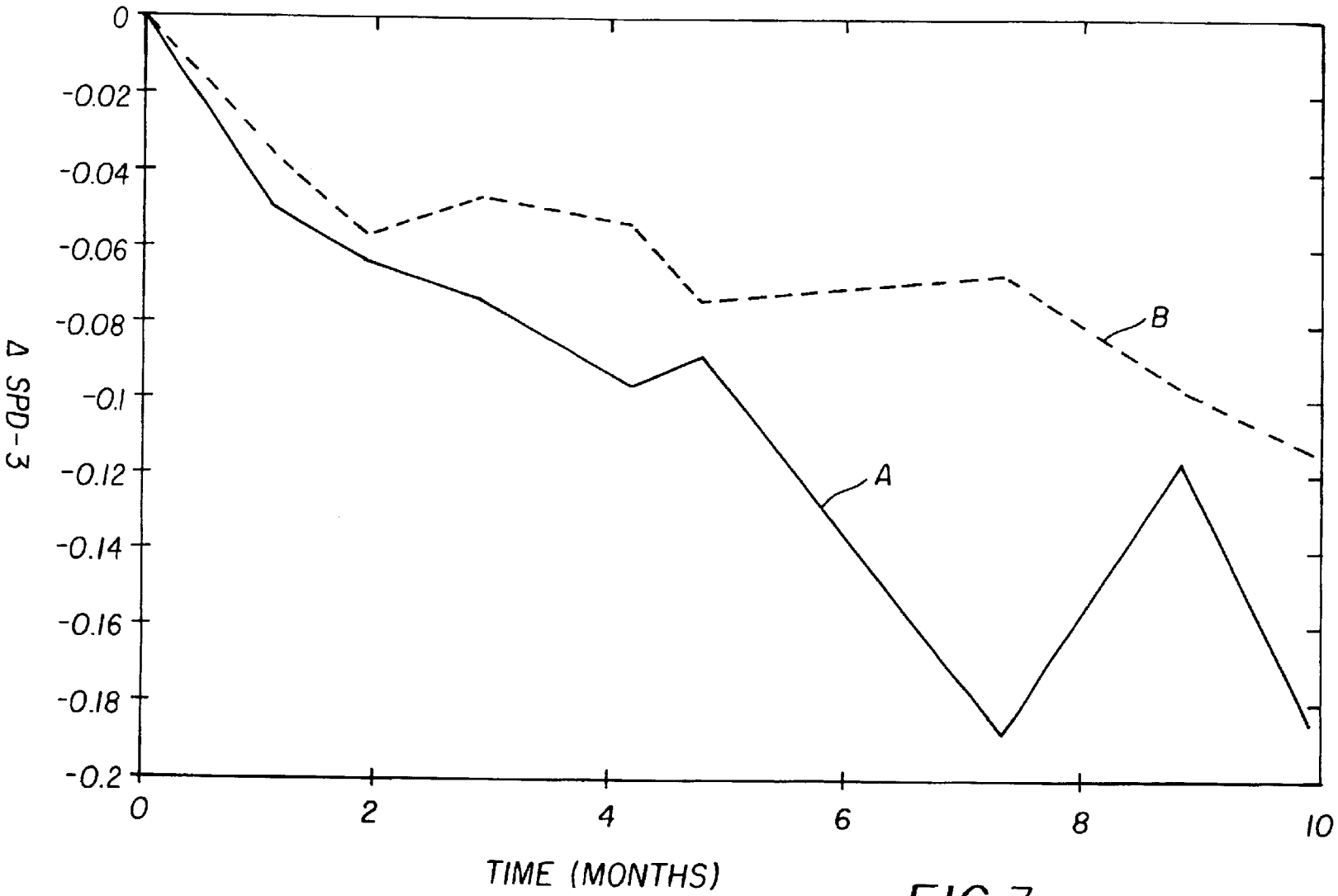
FIG. 3 is a graphical representation of the change in "SPD-3" of a photothermographic material with phthalazine (Curve B) and without phthalazine (Curve A) in the back coating vs. shelf aging time as described in Example 1 below.

The data, shown in FIG. 1, demonstrates that the presence of phthalazine (I-1) as a stabilizer in a backside layer in a test film provided improved control of shelf-aging fog, when the film sheets were stacked together providing contact between the backside of one sheet with the frontside of another sheet. Furthermore, the data, shown in FIGS. 2 and 3, demonstrates that improved contrast and photospeed retention was also achieved. In each of FIGS. 1–3, Curve A represents the Control data (no phthalazine on the backside) and Curve B represents the Invention data (phthalazine on the backside).

Examples 2–8

Backside stabilizer formulations containing different amounts of backside stabilizers were prepared and coated onto a support. These samples did not contain any photothermographic coatings on the front side.

Backside Stabilizer Formulation:

A master batch of backside stabilizer solution was prepared by mixing the following ingredients:

| | |
|---|---|
| CAB 381-20 | 108 parts |
| MEK | 792 parts |

A control backside formulation was prepared by mixing 5.33 parts MEK into 26.7 parts of the master batch solution.

Backside stabilizer formulations were prepared by mixing 0.077 parts of backside stabilizers with 5.33 parts MEK into 26.7 parts of the master batch solution. Backside stabilizers I-1, I-2, I-3, I4, and II-1 were used. This is referred to herein as the "1X" relative concentration of the backside stabilizers.

Another set of backside stabilizer formulation was prepared by mixing 1 part of the "1X" stabilizer backside solution with 3 parts of the master solution. These formulations therefore have only 25% of the "1X" formulations and are identified herein as the "0.25X" relative concentration. Backside stabilizers I-1, I-2, I-3, I-4, and II-1 were used.

Each of the formulations was coated onto a polyethylene terephthalate film support using a knife coater with a gap of 3.2 mils (81 $\mu$m). Immediately after coating, samples were dried in a forced air oven at between 77° C. and 99° C. for between 2 and 3 minutes.

The photothermographic materials were imagewise exposed, heat developed and scanned in the same manner as Example 1. The resulting data were used to calculate initial Dmin, contrast ("AC-1"), and photospeed ("SPD-3").

The effect of backcoat stabilizers of this invention on the shelf stability of the photothermographic materials was evaluated by stacking the backside of Control and Invention "test films" against the frontside (emulsion side) of samples of Kodak DRYVIEW Medical Imaging Film. The stacked films were bagged tightly in a high-density, flat-black polyethylene bag and allowed to "age" at 21° C. and 80% relative humidity for two months. Samples of the DRYVIEW films were imagewise exposed, heat developed, and scanned in the same manner described in Example 1 before and after aging. Changes (Δ) in Dmin, "AC-1", and ("SPD-3") were calculated.

Figure 4:
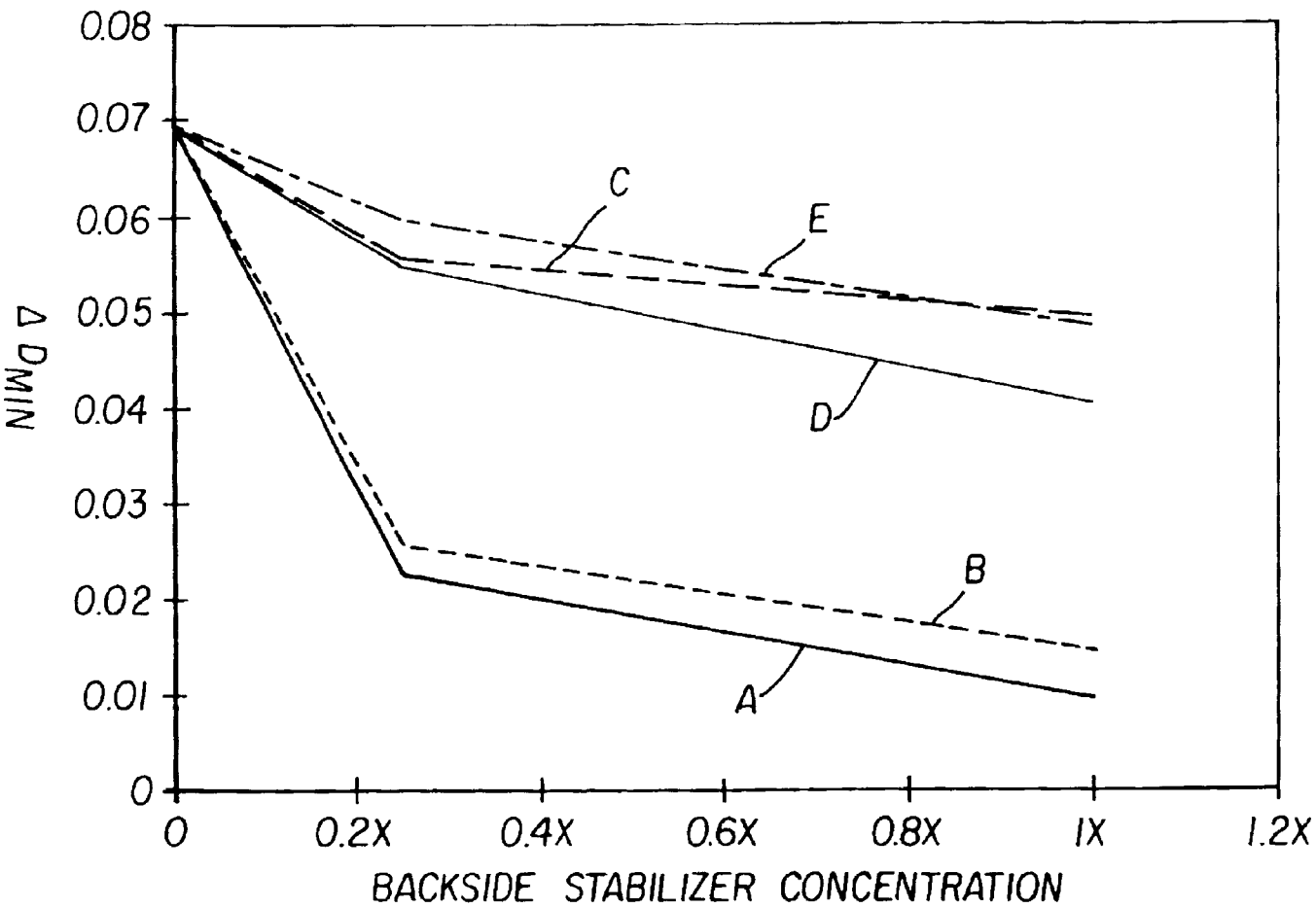
FIG. 4 is a graphical representation of the change in Dmin of a photothermographic material after aging for two months at 21° C. and 80% relative humidity vs. relative concentration of backside stabilizer as described in the Examples 2–8 below.
Figure 5:
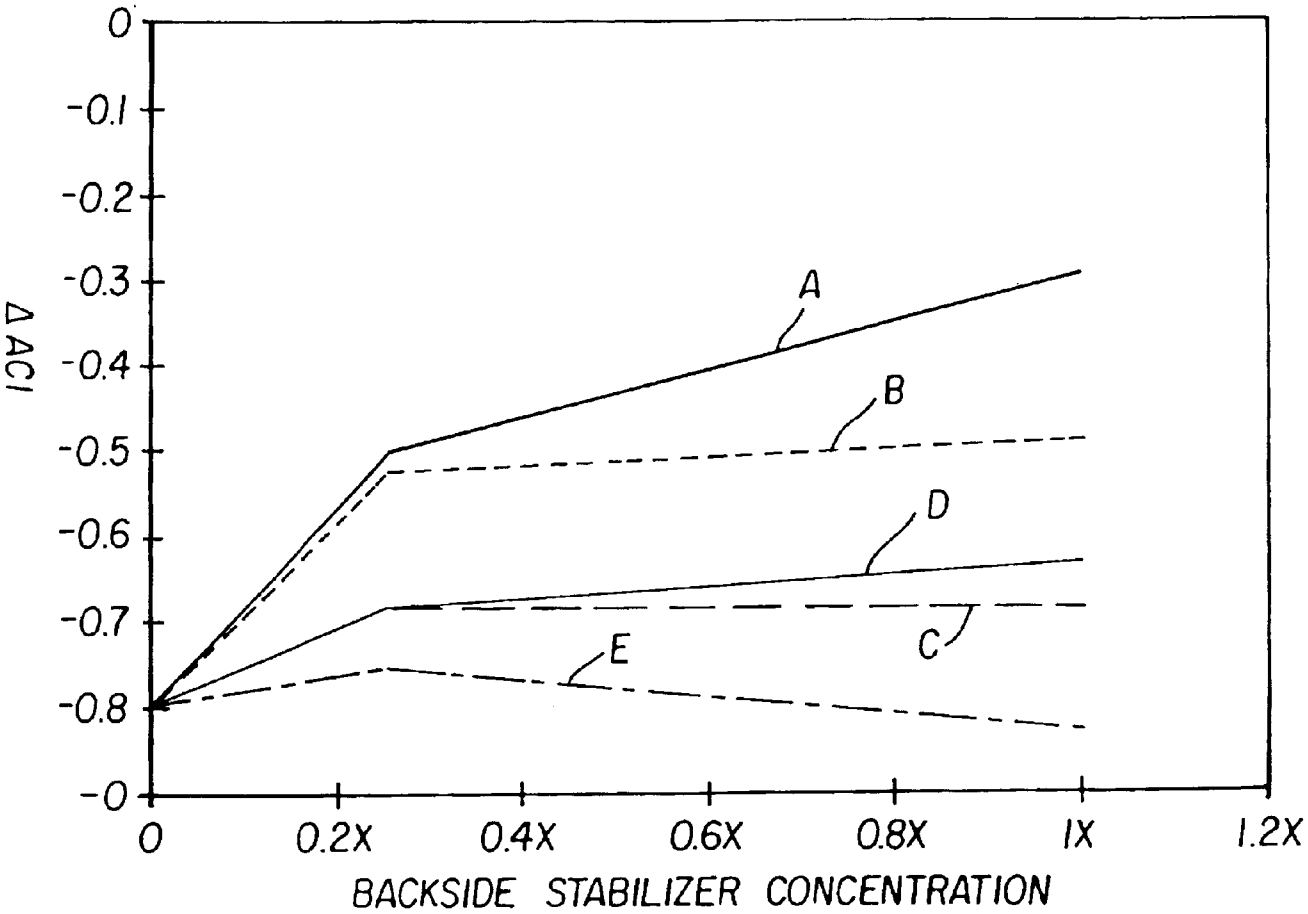
FIG. 5 is a graphical representation of the change in "AC-1" (average contrast) of a photothermographic material after aging for two months at 21° C. and 80% relative humidity vs. relative concentration of backside stabilizer as described in the Examples 2–8 below.
Figure 6:
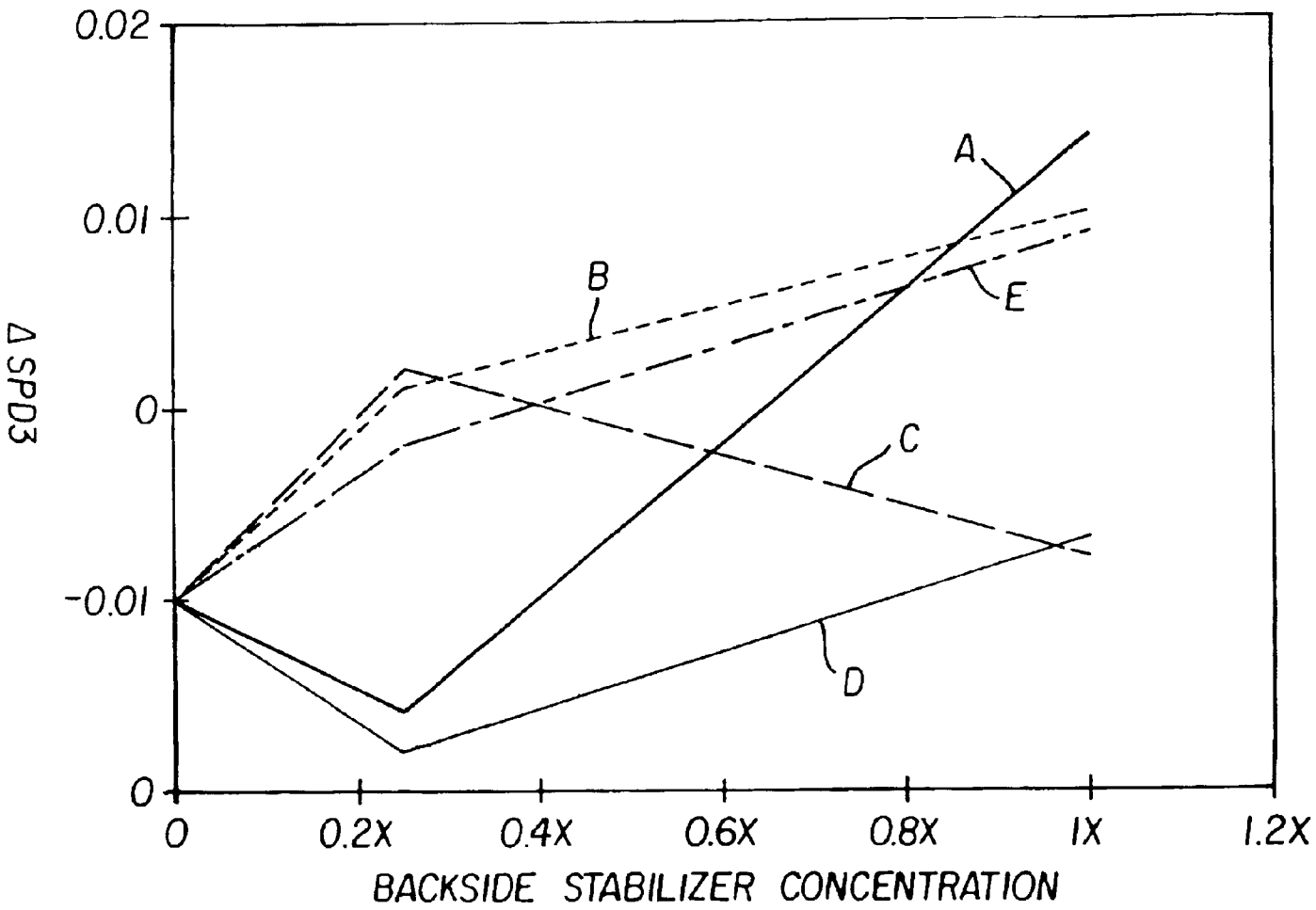
FIG. 6 is a graphical representation of the change in "SPD-3" (photospeed) of a photothermographic material after aging for two months at 21° C. and 80% relative humidity vs. relative concentration of backside stabilizer as described in the Examples 2–8 below.

FIG. 4 shows the change in Dmin (ΔDmin), FIG. 5 shows the change in contrast (ΔAC-1), and FIG. 6 shows the change in photospeed (ΔSPD-3) for these experiments. In all three figures, Curves A, B, C, D, and E represent the data for photothermographic material aged against backside coatings containing Compounds, I-1, I-2, I-3, I-4, and II-1, respectively.

The data show that increasing levels of Compounds, I-1, I-2, I-3, I-4, or II-1 as a stabilizer in a backside layer in a test film placed in contact with the frontside of a photothermographic material provide increasing control of shelf-aging fog with no loss in contrast and photospeed.

Examples 9–17

Backside stabilizer formulations containing different backside stabilizers were prepared and coated onto a support. These samples did not contain any photothermographic coatings on the front side.

Backside stabilizer formulations were coated as follows using various backside stabilizers.

Backside Stabilizer Formulation:

A master batch of backside solution was prepared by mixing the following ingredients:

| | |
|---|---|
| VITEL PE 2200 | 1.77 parts |
| CAB 381-20 | 125 parts |
| MEK | 822 parts |
| SYLOID 74X6000 | 1.52 parts dispersed in 1.83 parts CAB 381-20 and 44.5 parts MEK |

Control 1 backside formulation was prepared by mixing 5 parts MEK into 17 parts of the master batch solution. Control 2 backside formulation was prepared by mixing 5 parts MEK and 4 parts MeOH into 17 parts of the master batch solution.

Stabilizer backside formulations were prepared by mixing 17 parts of the master batch solution with a premix of a stabilizer compound. The premixes for the stabilizer compounds tested are listed below:

| | |
|---|---|
| Example 9 | 0.065 parts I-1 in 5 parts MEK |
| Example 10 | 0.072 parts I-15 in 5 parts MEK |
| Example 11 | 0.083 parts I-27 in 5 parts MEK |
| Example 12 | 0.104 parts I-29 in 5 parts MEK |
| Example 13 | 0.112 parts I-30 in 5 parts MEK |
| Example 14 | 0.080 parts I-31 in 5 parts MEK |
| Example 15 | 0.074 parts I-32 in 2 parts MEK and 2 parts MeOH |
| Example 16 | 0.082 parts III-1 in 5 parts MEK and 4 parts MeOH |
| Example 17 | 0.090 parts III-2 in 5 parts MEK and 4 parts MeOH |

Each of the noted formulations was coated onto polyethylene terephthalate film support using a knife coater with a gap of 3.0 mils (76.2 μm) for backside solutions without MeOH (methanol) and a gap of 3.5 mils (88.9 μm) for backside solutions containing MeOH. Example 15 was coated with a gap of 3.3 mils (83.8 μm). Immediately after coating, samples were dried in a forced air oven at between 77° C. and 99° C. for between 2 and 3 minutes.

The effect of the backside stabilizers of this invention on the shelf stability of photothermographic materials was evaluated by stacking the backside of Control and Invention "test films" against the frontside (emulsion side) of samples of Kodak DRYVIEW Medical Imaging Film. The stacked films were bagged tightly in a high-density, flat-black polyethylene bag and allowed to "age" at 21° C. and 80% relative humidity for 9 weeks. Samples of the DRYVIEW films were imagewise exposed, heat developed, and scanned in the same manner described in Example 1 before and after aging. Changes (Δ) in Dmin was calculated.

The results, shown below in TABLE I, demonstrate that when the stabilizer compounds listed are added to the back coat, the change in Dmin upon aging is reduced.

TABLE I

| Test Film | Stabilizer Compound | Δ Dmin |
|---|---|---|
| Control 1 | None | 0.163 |
| Example 9 | I-1 | 0.014 |
| Example 10 | I-15 | 0.038 |
| Example 11 | I-27 | 0.088 |
| Example 12 | I-29 | 0.147 |
| Example 13 | I-30 | 0.053 |
| Example 14 | I-31 | 0.076 |
| Control 2 | None | 0.171 |
| Example 15 | I-32 | 0.123 |
| Example 16 | III-1 | 0.091 |
| Example 17 | III-2 | 0.027 |

Examples 18–20

Backside stabilizer formulations containing different backside stabilizers were prepared and coated onto a support. These samples did not contain any photothermographic coatings on the front side.

Backside stabilizer formulations were coated as follows using various backside stabilizers.

Backside Stabilizer Formulation:

A master batch of backside solution was prepared in the same manner as described in Examples 9–17.

Control 3 backside formulation was prepared by mixing 5 parts MEK into 17 parts of master batch solution. Control 4 backside formulation was prepared by mixing 5 parts MEK and 4 parts MeOH into 17 parts of master batch solution.

Stabilizer backside formulations were prepared by mixing 17 parts of master batch solution with a premix of a stabilizer compound. The premixes for the stabilizer compounds tested are described below:

| | |
|---|---|
| Example 18 | 0.055 parts (IV-2) in 5 parts MEK |
| Example 19 | 0.082 parts III-3 in 5 parts MEK and 4 parts MeOH |
| Example 20 | 0.082 parts IV-1 in 5 parts MEK and 4 parts MeOH |

Each of the noted formulations was coated onto polyethylene terephthalate film support using a knife coater with a gap of 3.0 mil (76.2 μm) for backside solutions without MeOH (methanol) and a gap of 3.5 mil (88.9 μm) for backside solutions containing MeOH. Immediately after coating, samples were dried in a forced air oven at between 77° C. and 99° C. for between 2 and 3 minutes.

The effect of the backside stabilizers of this invention on the shelf stability of photothermographic materials was evaluated by stacking the backside of Control and Invention "test films" against the frontside (emulsion side) of samples of Kodak DRYVIEW Medical Imaging Film. The stacked films were bagged tightly in a high-density, flat-black polyethylene bag and allowed to "age" at 27° C. and 80% relative humidity for 4 weeks. Samples of the DRYVIEW films were imagewise exposed, heat developed, and scanned in the same manner described in Example 1 before and after aging. Changes (Δ) in Dmin were calculated.

The results, shown below in TABLE II, demonstrate that when the stabilizer compounds listed are added to the back coat, the change in Dmin upon aging is reduced.

TABLE II

| Test Film | Stabilizer Compound | Δ Dmin |
|---|---|---|
| Control 3 | None | 0.014 |
| Example 18 | IV-2 | 0.007 |
| Control 4 | None | 0.010 |
| Example 19 | III-3 | 0.005 |

The invention has been described in detail with particular reference to certain preferred embodiments thereof, but it will be understood that variations and modifications can be effected within the spirit and scope of the invention.

I claim:

1. A photothermographic material that comprises a support having on one side thereof, one or more thermally-developable imaging layers comprising a binder and in reactive association, a photosensitive silver halide, a non-photosensitive source of reducible silver ions, and a reducing composition for said non-photosensitive source reducible silver ions, and on the opposite side of said support, a backside layer comprising a pyridazine, phthalazine, phthalazinone, benzoxazine dione, benzthiazine dione, or quinazoline dione compound as a backside stabilizer.

2. The photothermographic material of claim 1 wherein said non-photosensitive source of reducible silver ions is a silver fatty acid carboxylate having 10 to 30 carbon atoms in the fatty acid or a mixture of said silver carboxylates.

3. The photothermographic material of claim 1 wherein said reducing composition comprises at least one hindered phenol.

4. The photothermographic material of claim 3 further comprising a high contrast co-developing agent.

5. The photothermographic material of claim 1 that is sensitive to radiation having a wavelength greater than 700 nm.

6. The photothermographic material of claim 1 wherein said backside layer is an antihalation layer further comprising an antihalation composition.

7. The photothermographic material of claim 6 wherein said backside layer is an antihalation composition comprising an antihalation dye.

8. The photothermographic material of claim 6 wherein said backside layer comprises an heat bleachable antihalation composition.

9. The photothermographic material of claim 1 wherein said backside stabilizer is represented by the following Structure I, II, III, or IV:

I

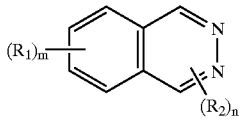

-continued

II

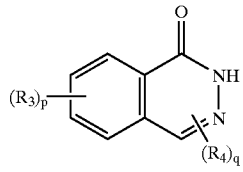

III

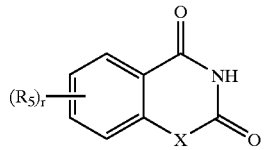

IV

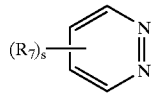

wherein, $R_1$, $R_2$, $R_3$, $R_4$, $R_5$, and $R_7$ each independently represent hydrogen, alkyl groups, cycloalkyl groups, alkoxy, groups, alkylthio groups, arylthio groups, hydroxy groups, halogen groups, or $N(R_8R_9)$ groups, or any two of $R_1$, $R_2$, $R_3$, $R_4$, $R_5$, or $R_7$ taken together represent the atoms necessary to form a fused aromatic, heteroaromatic, alicyclic, or heterocyclic ring, $R_8$ and $R_9$ each independently represent hydrogen, alkyl groups, aryl groups, cycloalkyl groups, alkenyl groups, and heterocyclic groups, or $R_8$ and $R_9$ taken together represent the atoms necessary to form a substituted or unsubstituted 5- to 7-membered heterocyclic ring, X represents O, S, Se, or $N(R_6)$, where $R_6$ represents hydrogen, alkyl groups, aryl groups, cycloalkyl groups, alkenyl groups, and heterocyclic groups, and m, n, p, q, r, and s are each independently 0, 1, or 2.

10. The photothermographic material of claim 9 wherein $R_1$, $R_2$, $R_3$, $R_4$, $R_5$, and $R_7$ are independently the same or different alkyl group of 1 to 4 carbon atoms, X is oxygen, and m, n, p, q, and r are independently 0 or 1.

11. The photothermographic material of claim 1 wherein said backside stabilizer is one of the following compounds I-1 to I-32, II-1 to II-4, III-1 to III-10, and IV-1 to IV-4:

I-1

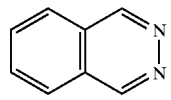

I-2

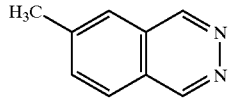

I-3

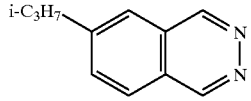

I-4

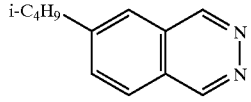

-continued
I-5
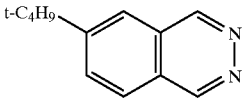
I-6
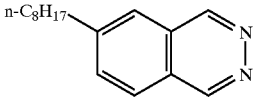
I-7
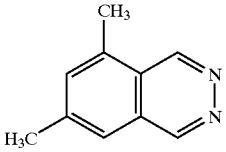
I-8
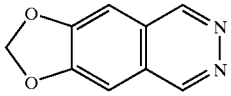
I-9
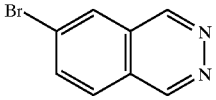
I-10
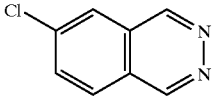
I-11
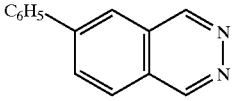
I-12
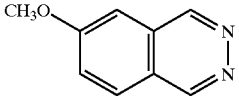
I-13
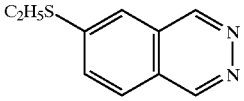
I-14
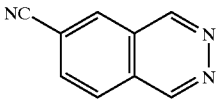
I-15
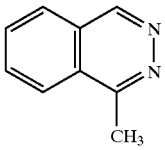
I-16
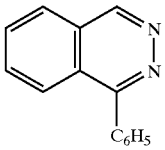
I-17
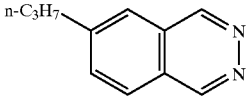
-continued
I-18
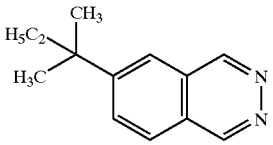
I-19
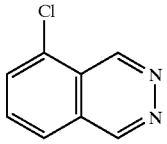
1-20
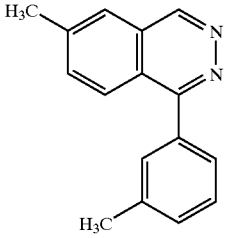
I-21
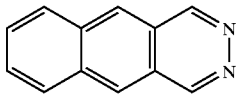
I-22
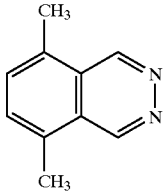
I-23
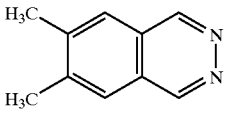
I-24
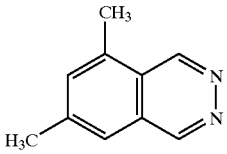
I-25
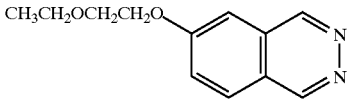
I-26
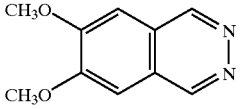
I-27
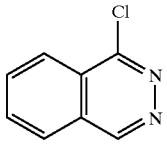

-continued
I-28
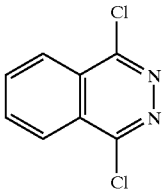
I-29
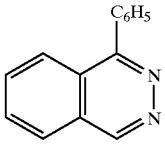
I-30
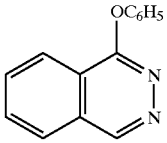
I-31
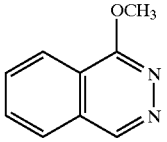
I-32
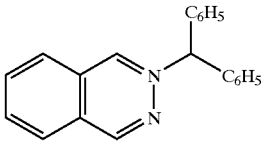
II-1
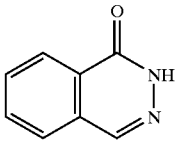
II-2
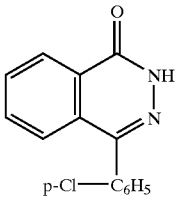
II-3
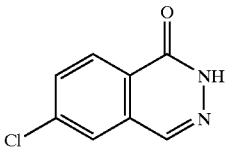
II-4
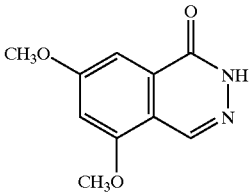
-continued
III-1
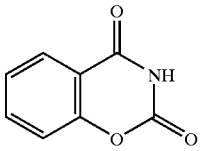
III-2
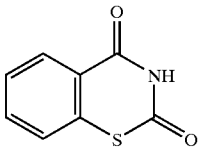
III-3
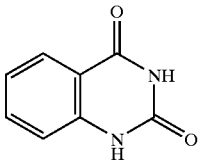
III-4
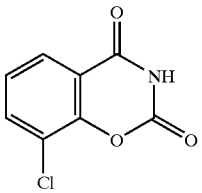
III-5
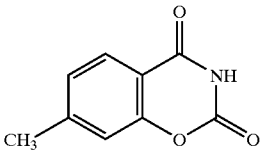
III-6
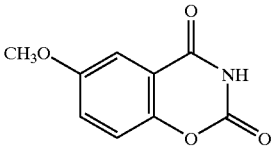
III-7
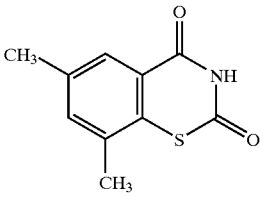
III-8
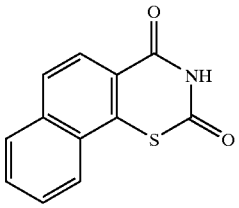

-continued

III-9

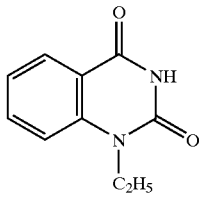

III-10

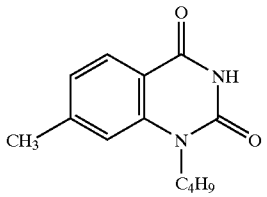

IV-1

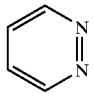

IV-2

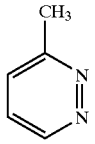

IV-3

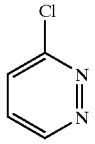

IV-4

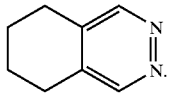

12. The photothermographic material of claim 1 wherein said backside stabilizer is present in said backside layer in an amount of at least 0.01 mmol/$m^2$.

13. The photothermographic material of claim 12 wherein said backside stabilizer is present in said backside layer in an amount of from about 0.05 to about 5 mmol/$m^2$.

14. The photothermographic material of claim 1 wherein said backside layer is the sole layer on that side of said support.

15. The photothermographic material of claim 1 further comprising a toner in said one or more imaging layers.

16. The photothermographic material of claim 15 wherein said toner is a pyridazine, phthalazine, phthalazinone, benzoxazine dione, benzthiazine dione, or quinazoline dione compound.

17. The photo-thermo-graphic material of claim 1 wherein said backside layer comprises a phthalazine as a backside stabilizer.

18. The photothermographic material of claim 1 wherein said backside layer comprises a cellulose acetate binder, and said pyridazine phthalazine, phthalazinone, benzoxazine dione, benzthiazine dione, or quinazoline dione compound is represented by the following Structures I, II, III, or IV:

I

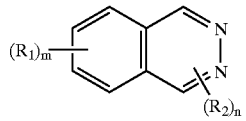

II

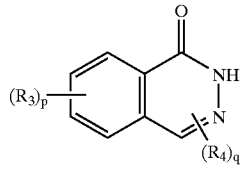

III

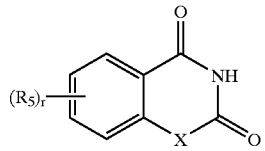

IV

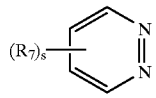

wherein $R_1$ $R_2$, $R_3$, $R_4$, $R_5$, and $R_7$ each independently represent hydrogen, alkyl groups, cycloalkyl groups, alkoxy, groups, alkylthio groups, arylthio groups, hydroxy groups, N-$R_8R_9$ groups, or halogen groups, or any two of $R_1$, $R_2$, $R_3$, $R_4$, $R_5$, or $R_7$ taken together may represent the atoms necessary to form a fused aromatic, heteroaromatic, alicyclic, heterocyclic ring, X represents O, S, Se, or N-$R_6$, $R_6$, $R_8$ and $R_9$ each independently represent hydrogen, alkyl groups, aryl groups, cycloalkyl groups, alkenyl groups, substituted or alkynyl groups, and heterocyclic groups or $R_8$ and $R_9$ taken together can form a substituted or unsubstituted 5- to 7-membered heterocyclic ring, and m, n, p, q, r, and s are each independently 0, 1, or 2.

19. A photothermographic material that comprises a support having on one side thereof, one or more thermally-developable imaging layers comprising a binder and in reactive association, a photosensitive silver halide, a non-photosensitive source of reducible silver ions, and a reducing composition for said non-photosensitive source reducible silver ions, and on the opposite side of said support, a backside layer comprising a toner as a backside stabilizer.

20. A photothermographic material that comprises a support having on one side thereof, one or more thermally-developable imaging layers comprising a binder and in reactive association, a photosensitive silver halide, a non-photosensitive source of reducible silver ions, and a reducing composition for said non-photosensitive source reducible silver ions, and on the opposite side of said support, a backside layer comprising a phthalazine as a backside stabilizer.

21. A photothermographic material that comprises a polyester support having on the frontside thereof:

a) one or more thermally-developable imaging layers comprising a hydrophobic binder and in reactive association:

a photosensitive silver bromide, silver iodobromide, or mixture thereof, a non-photosensitive source of reducible silver ions that comprises one or more silver carboxylates at least one of which is silver behenate, a reducing composition for said non-photosensitive source reducible silver ions, and toner that is a phthalazine or phthalazinone, and b) on the backside of said support, an antihalation layer comprising an antihalation composition and pyridazine, phthalazine, phthalazinone, benzoxazine dione, benzthiazine dione, or quinazoline dione compound that is represented by the following Structures I, II, III, or IV:

I

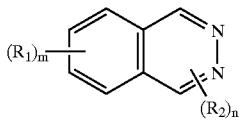

II

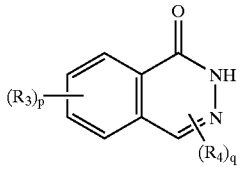

III

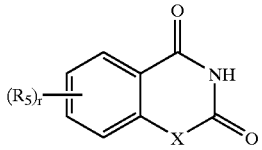

IV

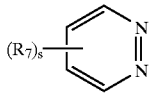

wherein, $R_1$, $R_2$, $R_3$, $R_4$, $R_5$, and $R_7$ each independently represent hydrogen, alkyl groups, cycloalkyl groups, alkoxy, groups, alkylthio groups, arylthio groups, hydroxy groups, halogen groups, or $N(R_8R_9)$ groups, or any two of $R_1$, $R_2$, $R_3$, $R_4$, $R_5$, or $R_7$ taken together represent the atoms necessary to form a fused aromatic, heteroaromatic, alicyclic, or heterocyclic ring, $R_8$ and $R_9$ each independently represent hydrogen, alkyl groups, aryl groups, cycloalkyl groups, alkenyl groups, and heterocyclic groups, or $R_8$ and $R_9$ taken together represent the atoms necessary to form a substituted or unsubstituted 5- to 7-membered heterocyclic ring, X represents O, S, Se, or $N(R_6)$, where $R_6$ represents hydrogen, alkyl groups, aryl groups, cycloalkyl groups, alkenyl groups, and heterocyclic groups, and m, n, p, q, r, and s are each independently 0, 1, or 2.

22. A method of forming a visible image comprising:

A) imagewise exposing the photothermographic material of claim 1 to electromagnetic radiation to form a latent image, B) simultaneously or sequentially, heating said exposed photothermographic material to develop said latent image into a visible image.

23. The method of claim 22 wherein said photothermographic material comprises a transparent support, and said image-forming method further comprising:

C) positioning said exposed and heat-developed photothermographic material with a visible image therein, between a source of imaging radiation and an imageable material that is sensitive to said imaging radiation, and D) thereafter exposing said imageable material to said imaging radiation through the visible image in said exposed and heat-developed photothermographic material to provide a visible image in said imageable material.

* * * * *